US008403241B2

(12) United States Patent
Jung

(10) Patent No.: US 8,403,241 B2
(45) Date of Patent: Mar. 26, 2013

(54) FILTER CASE FOR SHOWER HAVING FUNCTION OF ADJUSTING QUANTITY OF OUTFLOW OF FILLING MATERIAL

(75) Inventor: Ji-Haeng Jung, Daejeon (KR)

(73) Assignee: KNTEC Co., Ltd. (KR)

( * ) Notice: Subject to any disclaimer, the term of this patent is extended or adjusted under 35 U.S.C. 154(b) by 12 days.

(21) Appl. No.: 12/743,728

(22) PCT Filed: Jul. 22, 2009

(86) PCT No.: PCT/KR2009/004080

§ 371 (c)(1),
(2), (4) Date: May 19, 2010

(87) PCT Pub. No.: WO2010/095792

PCT Pub. Date: Aug. 26, 2010

(65) Prior Publication Data

US 2011/0290913 A1 Dec. 1, 2011

(30) Foreign Application Priority Data

Feb. 18, 2009 (KR) ..... 10-2009-0013473

(51) Int. Cl.
*B05B 1/14* (2006.01)

(52) U.S. Cl. ..... 239/590; 239/525; 239/571; 239/581.1; 137/519.5; 137/533.11; 251/122; 251/352

(58) Field of Classification Search ..... 239/570, 239/571, 581.2, 590, 310, 525; 137/519.5, 137/528, 533.11; 251/121, 122, 185, 351, 251/352

See application file for complete search history.

(56) References Cited

U.S. PATENT DOCUMENTS 3,830,252 A * 8/1974 Follett ..... 137/519.5
4,529,167 A * 7/1985 Harrison et al. ..... 251/144

FOREIGN PATENT DOCUMENTS

| | | |
|---|---|---|
| JP | 2001-000351 | 1/2001 |
| JP | 2001-128875 | 5/2001 |
| KR | 20-1998-063447 | 11/1998 |
| KR | 20-0273897 | 4/2002 |
| KR | 10-2002-0037031 | 5/2002 |
| KR | 20-0300748 | 12/2002 |
| KR | 20-0312845 | 5/2003 |
| KR | 20-0318876 | 7/2003 |
| KR | 10-2004-0053782 | 6/2004 |

OTHER PUBLICATIONS

International Search Report—PCT/KR2009/004080 dated Mar. 9, 2010.

* cited by examiner

*Primary Examiner* — Jason Boeckmann
(74) *Attorney, Agent, or Firm* — Cantor Colburn LLP

(57) ABSTRACT

The present invention relates to a filter case for a shower having a function of adjusting a quantity of outflow of a filling material, the filter case including: a cylindrical body having a predetermined length and one end portion opened, for containing a filling material into the interior thereof; and an outflow quantity-adjusting means having a fixing part having one or more communicating holes adapted to communicate with the interior and exterior of the body, the fixing part being fitted to one end portion opened of the body and a rotating part having a discharge hole formed at the inside thereof in such a manner as to be passed through the upper and lower surfaces thereof, the rotating part being screw-coupled to the inner periphery of the fixing part so as to block the communicating holes of the fixing part.

4 Claims, 6 Drawing Sheets

FILTER CASE FOR SHOWER HAVING FUNCTION OF ADJUSTING QUANTITY OF OUTFLOW OF FILLING MATERIAL

BACKGROUND

1) Field

The present invention relates to a filter case for a shower, and more particularly, to a filter case for a shower having a function of adjusting a quantity of outflow of a filling material wherein a quantity of outflow of the filling material filled in the filter case like water-soluble gel, powder, and so on is adjusted arbitrarily by a user.

2) Description of the Related Art

Filter cases for a shower are disclosed in Korean Patent Registration No. 10-0429342 entitled 'water-feeder having function of continuously discharging solution mixed therein' and in Korean Patent Registration No. 10-0849855 entitled 'gel-filling case for shower'.

In the prior arts, the filter case for the shower, which includes a gel or powder type filling material containing aroma, oriental medicinal materials, vitamin C, and the like, is embedded inside the shower, such that the filling material is melted together with the water (for example, tap water) flowing along the shower, thereby neutralizing chlorine in the water, supplying the water good for a user's skin, and emitting the aroma for relaxing the user's body and mind.

However, the conventional filter case has a disadvantage in that the quantity of outflow of the filling material cannot be adjusted arbitrarily by the user. That is, the conventional filter case is configured to discharge a fixed quantity of filling material through a discharge hole formed at one end thereof, irrespective of the user's intention, such that the quantity of outflow of the filling material is not adjusted freely by the user.

Furthermore, the filter case for the shower is generally made of a plastic material, and therefore, the filling material may be excessively discharged from the discharge hole of the filter case when the use of the shower stops, thereby shortening the use term of the filling material.

That is, the water flowing along the shower partially enters the inside of the filter case through the discharge hole of the filter case, thereby making the filling material dissolved, and then, the water is discharged to the outside through the discharge hole of the filter case and is mixed with the water flowing along the shower. At this time, if the water flows to the interior of the filter case, the filter case is expanded in proportion with the quantity of water flowing to the filter case, and in this case, if the flowing of the water stops by the stop of the use of the shower, the expanded filter case is contracted and returned to its original shape by the difference of pressures of the inside and outside of the filter case. At this time, the filling material is excessively discharged by the pressure formed by the contraction of the filter case, thereby making the use term of the filling material shortened.

According to the conventional filter cases, moreover, the discharge hole is kept closed by means of an adhesive tape, and thus, the discharge hole is not completely sealed, which makes it difficult to be kept for a long period of time, that is, for six months or more. Additionally, the vitamin C, as a component of the filling material, is naturally oxidized by the contact with air and water and is changed to dark red color, which gives a bad influence on the marketability of the product. Accordingly, the filter case having the discharge hole closed by means of the adhesive tape should be vacuum-packed by vinyl one more so as to furthermore extend the keeping period of time of the filter case.

SUMMARY

Accordingly, the present invention has been made in view of the above-mentioned problems occurring in the prior art, and it is an object of the present invention to provide a filter case for a shower having a function of adjusting a quantity of outflow of a filling material wherein a quantity of outflow of the filling material filled in the filter case is adjusted arbitrarily by a user.

It is another object of the present invention to provide a filter case for a shower having a function of adjusting a quantity of outflow of a filling material wherein the filling material is not discharged upon the stop of the use of the shower and is kept for a long period of time, which provides an economical advantage to a user.

To achieve the above objects, according to the present invention, there is provided a filter case for a shower having a function of adjusting a quantity of outflow of a filling material, the filter case being embedded at the inside of the shower in the state where a water-soluble filling material is filled thereinto, the filter case including: a cylindrical body having a predetermined length and one end portion opened, for containing the filling material into the interior thereof; and an outflow quantity-adjusting means having a fixing part having one or more communicating holes adapted to communicate with the interior and exterior of the body, the fixing part being fitted to one end portion opened of the body, and a rotating part having a discharge hole formed at the inside thereof in such a manner as to be passed through the upper and lower surfaces thereof, the rotating part being screw-coupled to the inner periphery of the fixing part so as to block the communicating holes of the fixing part, wherein as the rotating part is rotated around the fixing part, the communicating holes of the fixing part are opened to form a space portion having a predetermined size between the communicating holes of the fixing part and the discharge hole of the rotating part, thereby adjusting the quantity of outflow of the filling material.

Desirably, the fixing part has a tapered projection formed at the center of the bottom portion thereof in such a manner as to be reduced in diameter toward the upper portion thereof, and the rotating part has a tapered recess adapted to insert the projection of the fixing part thereinto in such a manner as to communicate with the discharge hole, such that as the rotating part is rotated around the fixing part, the size of the space portion formed between the projection and the recess is adjusted to regulate the quantity of outflow of the filling material.

Desirably, the outflow quantity-adjusting means has a ball member disposed between the projection and the recess, the ball member being adapted to block the discharge hole by the pressure formed from the body when the shower stops, thereby preventing the filling material from being discharged.

Desirably, the rotating part has a packing member mounted along the outer periphery thereof, the packing member being adapted to provide water tightness between the rotating part and the fixing part.

Desirably, the rotating part has a longitudinal slot concavedly formed on the top surface thereof in such a manner as to insert a tool like a driver, a coin, and so on thereinto, thereby rotating the rotating part.

Desirably, the rotating part has a plurality of marks formed along the top periphery thereof in such a manner as to be spaced apart from each other by a predetermined distance, the plurality of marks being formed of characters or numbers indicating the discharge quantities of the filling material.

According to the present invention, the filter case for the shower has a function of arbitrarily adjusting the quantity of outflow of the filling material by the user, which makes it convenient to use for a long period of time.

According to the filter case for the shower, moreover, the filling material is not discharged upon the stop of the use of the shower, which makes it possible to use for long term, thereby providing an economical advantage to the user.

According to the filter case for the shower, also, the filter case is completely closed, which makes it possible to be kept for a long period of time, thereby providing an economical advantage to the user.

DETAILED DESCRIPTION

An explanation on a filter case for a shower having a function of adjusting a quantity of outflow of a filling material according to the present invention will be given in detail with reference to the attached drawings.

Figure 1:
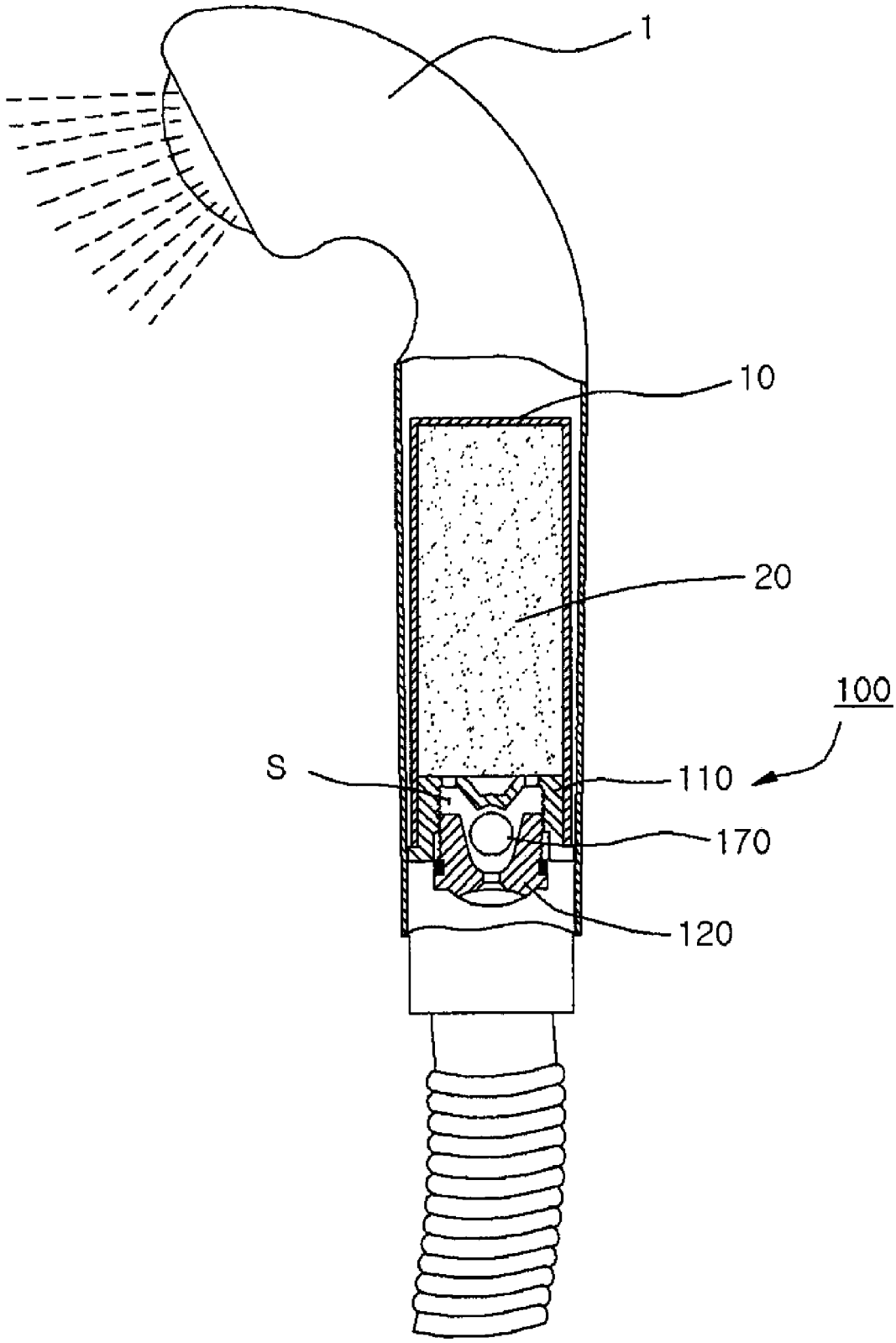
FIG. 1 is a perspective view showing a filter case for a shower having a function of adjusting a quantity of outflow of a filling material according to the present invention, wherein the filter case is embedded inside the shower.
Figure 2:
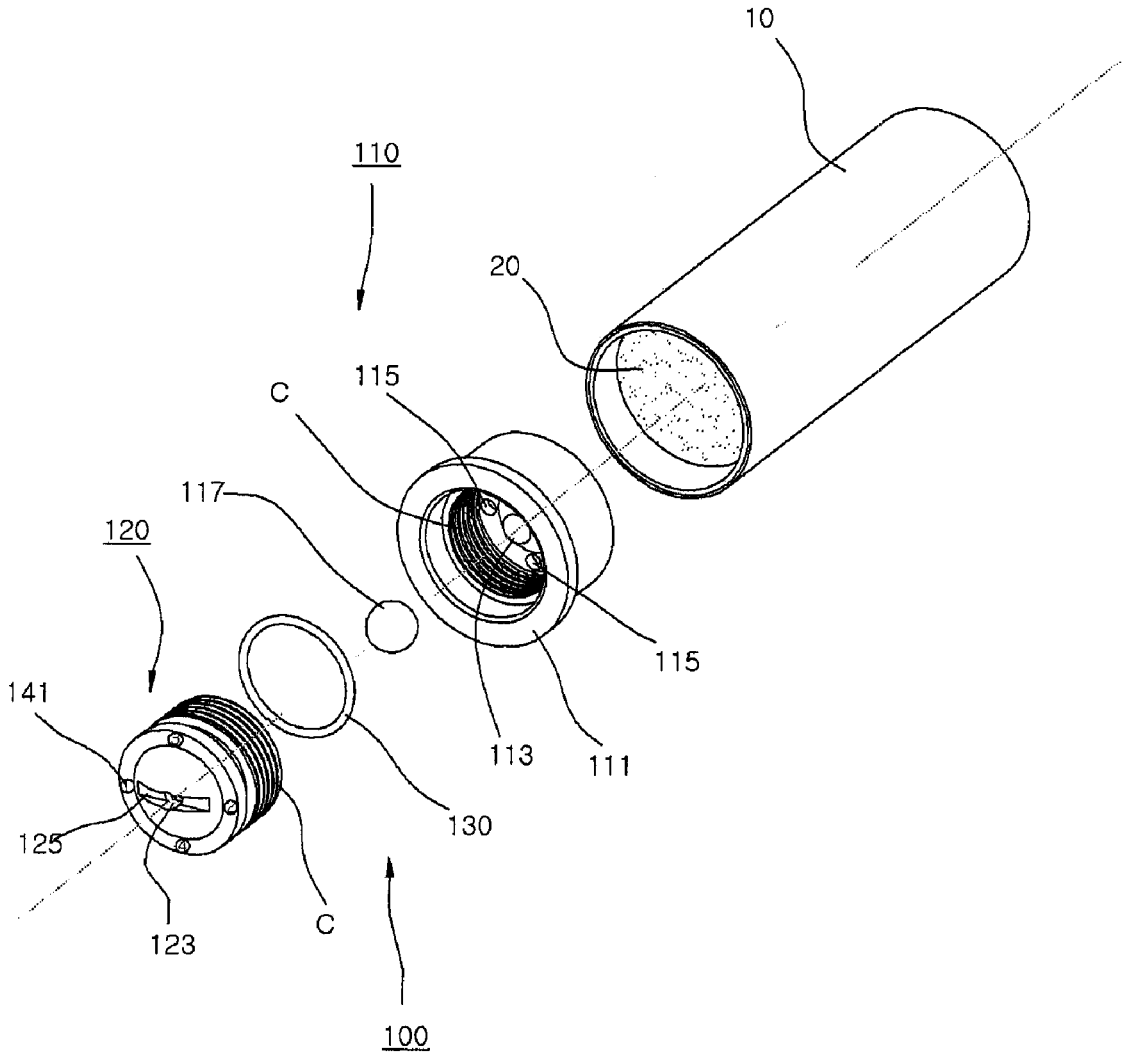
FIG. 2 is a separate perspective view showing the filter case for a shower according to the present invention.
Figure 3:
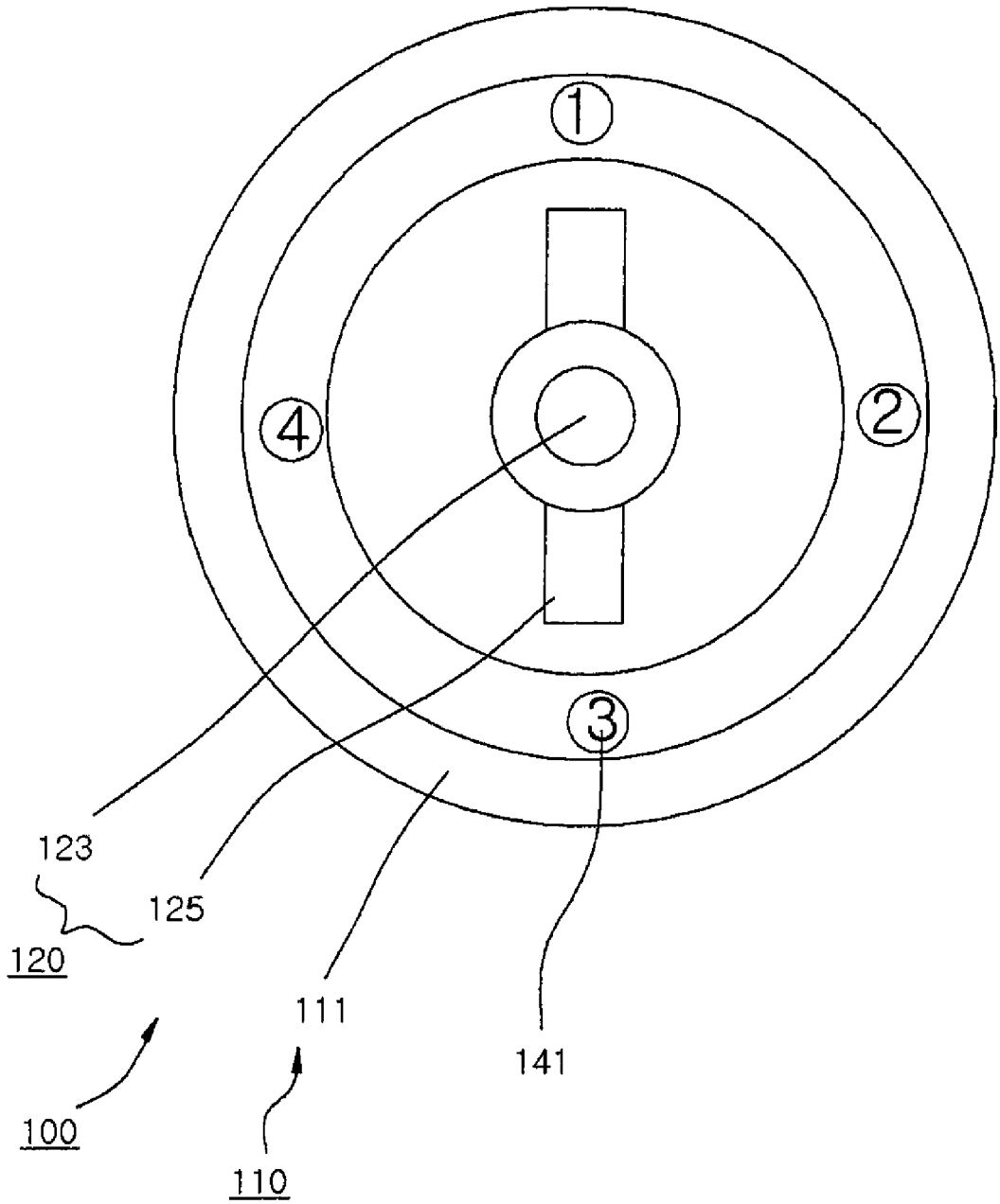
FIG. 3 is a plane view showing the filter case for a shower according to the present invention.
Figure 4:
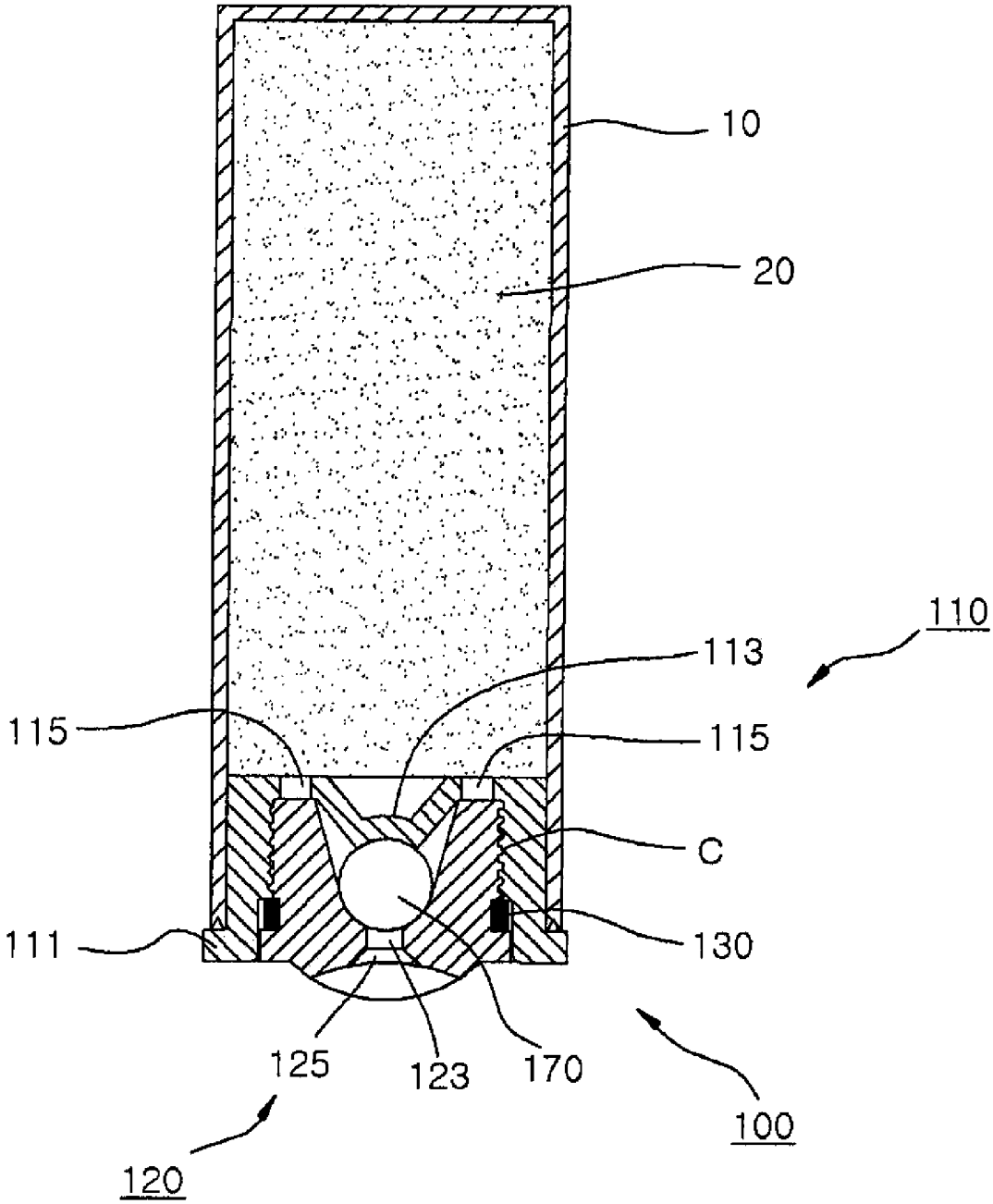
FIG. 4 is a sectional view showing the filter case for a shower according to the present invention at the time of being shipped as a product.
Figure 5:
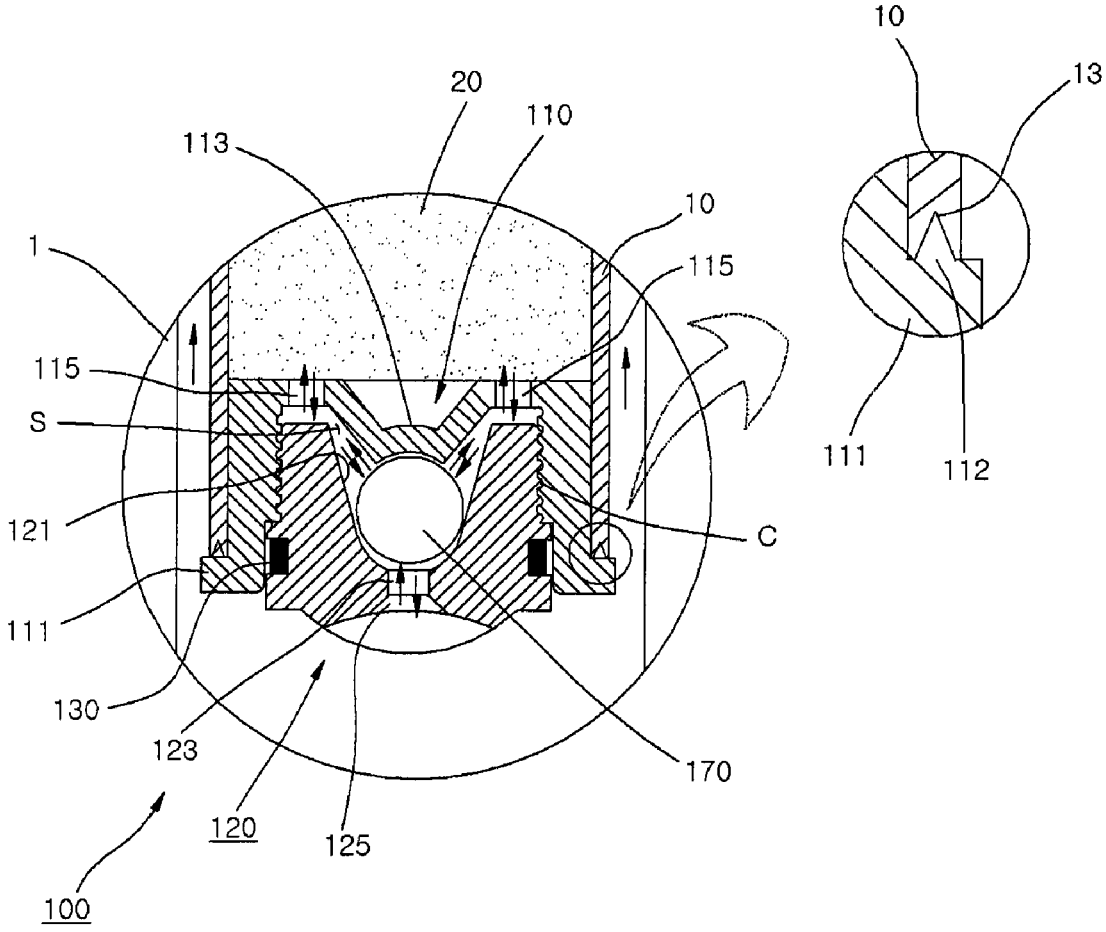
FIGS. 5 to 7 are partly enlarged views showing the use state of the filter case for a shower according to the present invention.
Figure 6:
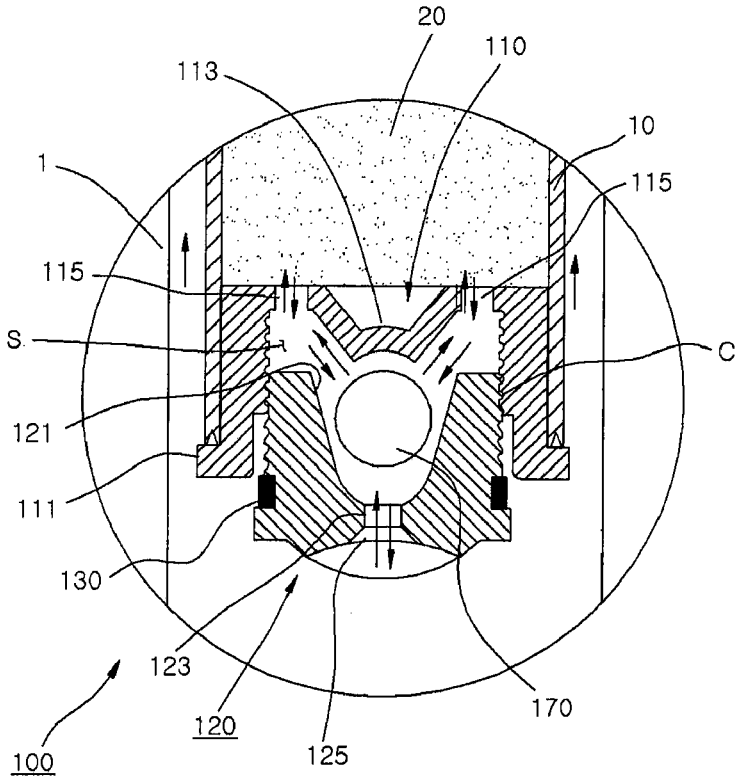
Figure 7:
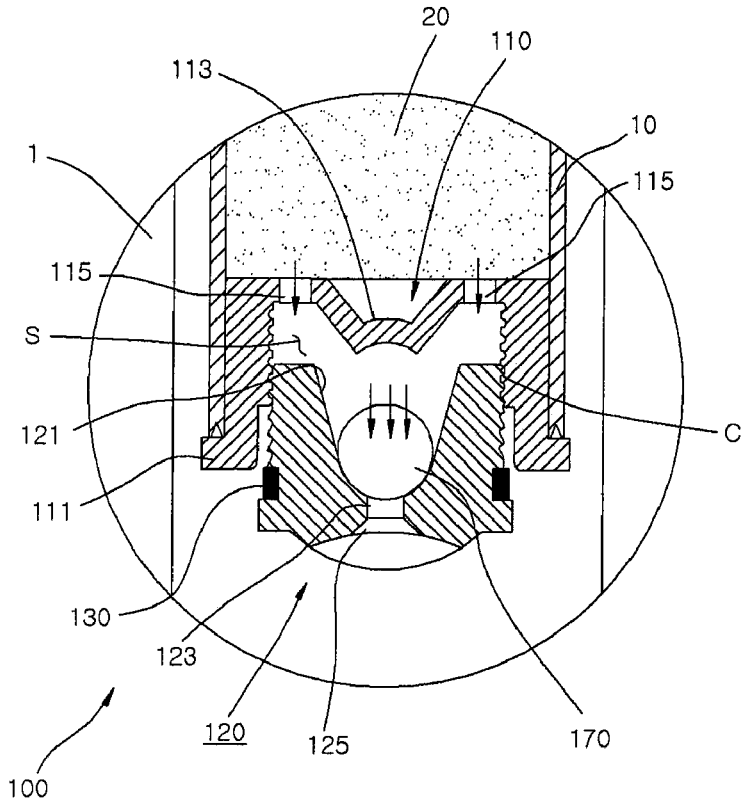

FIG. 1 is a perspective view showing a filter case for a shower having a function of adjusting a quantity of outflow of a filling material according to the present invention, wherein the filter case is embedded inside the shower, FIG. 2 is a separate perspective view showing the filter case for a shower according to the present invention, and FIG. 3 is a plane view showing the filter case for a shower according to the present invention, FIG. 4 is a sectional view showing the filter case for a shower according to the present invention at the time of being shipped as a product, FIGS. 5 to 7 are partly enlarged views showing the use state of the filter case for a shower according to the present invention.

As shown in the drawings, a filter case for a shower having a function of adjusting a quantity of outflow of a filling material according to the present invention includes a cylindrical body 10 having one end portion opened and a filling material 20 like watersoluble gel, powder, and so on filled to the interior thereof. The body 10 is desirably made of a plastic material, and the filling material 20 contains components such as herbs (e.g., aroma, herbal fragrance like rosemary, flower fragrance like rose fragrance), oriental medicinal materials, vitamin C, and so on.

An outflow quantity-adjusting means 100 is mounted at one end portion opened of the body 10. The outflow quantity-adjusting means 100 includes a fixing part 110 and a rotating part 120. As the rotating part 120 is rotated around the fixing part 110 by means of a screw C, a size of a space portion S formed between the rotating part 120 and the fixing part 110 is adjusted, thereby adjusting the quantity of outflow of the filling material 20 filled in the interior of the body 10 of the filter case.

In other words, the fixing part 110 has a '⊏'-shaped sectional area on which a screw C is formed along the inner peripheral surface thereof in such a manner as to be insertedly fitted to one end portion opened of the body 10. The fixing part 110 has a flange 111 formed on the upper portion thereof in such a manner as to be locked to one end portion opened of the body 10. The flange 111 serves to support the fixing part 110 upon the rotation of the rotating part 120 so as to prevent the fixing part 110 from being pushed toward the interior of the body 10.

Further, the flange 111 has a fitting protrusion 112 formed along the underside portion thereof, and the body 10 has a fitting groove 13 formed along the end surface of one end portion opened thereof in such a manner as to insert the fitting protrusion 112 thereinto, thereby stably fixing the fixing part 110 to one end portion opened of the body 10.

The fixing part 110 has a conically tapered projection 113 formed at the center of the bottom portion thereof in such a manner as to be reduced in diameter toward the upper portion thereof, and the projection 113 has one or more communicating holes 115 spaced apart from each other by a predetermined distance on the peripheral surface thereof along the bottom periphery of the fixing part 110.

The communicating holes 115 serve to allow the water flowing along a shower 1 to enter the interior of the body 10 so as to dissolve the filling material 20 and to allow the water in which the filling material 20 is dissolved to be discharged from the interior of the body 10.

The rotating part 120 has a screw portion C formed along the outer peripheral surface thereof in such a manner as to be screw-coupled to the screw portion C of the fixing part 110 and to be rotatable around the fixing part 110. The rotating part 120 has a tapered recess 121 formed on the center of the lower portion thereof in such a manner as to be reduced in diameter toward the upper portion thereof, and the tapered recess 121 is adapted to insert the projection 113 of the fixing part 110 thereinto. Also, the rotating part 120 has a discharge hole 123 formed at the center of the inside thereof in such a manner as to be passed through the top surface of the groove 113 and the top surface of the rotating part 120.

The discharge hole 123 serves to allow the water flowing along the shower 1 to enter the interior of the body 10 through the communicating holes 115 of the fixing part 110 and to allow the water in which the filling material 20 is dissolved flowing through the communicating holes 115 of the fixing part 110 to be discharged to the outside and mixed with the water flowing along the shower 1.

The rotating part 120 has a packing member 130 mounted along the outer periphery thereof so as to apply water tightness between the rotating part 120 and the fixing part 110, and the packing member 130 is made of a resin material like rubber. Desirably, the rotating part 120 has a longitudinal slot 125 concavedly formed on the top surface thereof in such a manner as to insert a tool like a driver, a coin, and so on thereinto, thereby rotating the rotating part 120.

As shown in FIG. 4, the filter case according to the present invention is shipped as a product in the state where the rotating part 120 is completely fastened to the fixing part 110. If the rotating part 120 is fully fastened to the fixing part 110, the bottom surface of the rotating part 120 firmly closes the communicating holes 115 of the fixing part 110, and further, when an adhesive tape is attached on the top surface of the rotating part 120 to close the discharge hole 123, the body 10 is completely closed.

Moreover, the formation of the packing member 130 permits the space between the rotating part 120 and the fixing part 110 to be tightly sealed, thereby preventing water from being permeated to the interior of the body 10.

Therefore, the filter case of the present invention solves the problem that since the vitamin C, as a component of the filling material, is naturally oxidized by the contact with water, the marketability of the product is deteriorated. Also, the filter case of the present invention solves the problem that the process of attaching the adhesive tape to the discharge hole is needed so as to prevent the filling material from being oxidized.

As a result, the filter case of the present invention can extend a period of time for keeping the filling material therein, which gives many economical advantages to the user.

If it is desired to use the filter case of the present invention, as shown in FIG. 1, the filter case is first embedded into the interior of the shower 1 in the state where the adhesive tape closing the discharge hole 123 is removed, and at this time, the discharge hole 123 is disposed to turn against the water flowing along the shower 1, that is, toward the head of the shower 1. Alternatively, as shown, the discharge hole 123 is disposed opposite to the water flowing along the shower 1.

The filter case discharges the filling material 20 irrespective of the direction of the formation of the discharge hole 123, thereby neutralizing chlorine in the water, supplying the water good for the user's skin, and emitting light aroma for relaxing the user's body and mind.

As shown in FIGS. 5 and 6, the outflow quantity-adjusting means 100 is embedded in the interior of the shower 1 in the state where the rotating part 120 is rotated by inserting the tool like a driver, a coin, or a nail into the longitudinal slot 125. In other words, the outflow quantity-adjusting means 100 is embedded in the interior of the shower 1 in the state where the rotating part 120 firmly fastened to the fixing part 110 is somewhat unfastened from the fixing part 110. As the rotating part 120 is rotated, the communicating holes 115*a* of the fixing part 110 closed by the rotating part 120 are opened, such that the space portion S is naturally formed between the rotating part 120 and the fixing part 110, that is, between the projection 113 and the recess 121, thereby allowing the communicating holes 115 of the fixing part 110 to communicate with the discharge hole 123 of the rotating part 120.

The space portion S forms the passageway moving the water flowing through the discharge hole 123 toward the communicating holes 115, thereby enabling the water to flow to the interior of the body 10, and also, the space portion S forms the passageway the water in which the filling material 20 is dissolved flowing along the communicating holes 115 toward the discharge hole 123, thereby enabling the water to be mixed with the water flowing along the shower 1. The quantity of outflow of the filling material 20 moving through the communicating holes 115 is dependent upon the size of the space portion S.

For example, when the rotating part 120 is furthermore rotated from the fixing part 110, the size of the space portion S as shown in FIG. 6 is formed larger than that as shown in FIG. 5, such that the quantity of the filling material 20 filled in the space portion S is increased to cause the quantity of filling material moving through the communicating holes 115 to be increased, thereby continuously discharging the filling material 20 having a relatively high density from the discharge hole 123.

As the rotating part 120 is rotated, the size of the space portion S formed between the fixing part 110 and the rotating part 120 is adjusted to control the quantity of outflow of the filling material 20, such that the quantity of outflow of the filling material 20 filled in the body 10 can be adjusted arbitrarily by the manipulation of the user, which makes it convenient to use and the quantity of filling material consumed can be reduced under the user's intention, which makes it possible to use for a long period of time.

Moreover, the rotating part 120 has a plurality of marks 141 formed along the top periphery thereof in such a manner as to be spaced apart from each other by a predetermined distance, the plurality of marks 141 being formed of characters or numbers indicating the discharge quantities of the filling material 20, which improves the convenience in use.

At this time, the marks 141 are made correspondingly to the sizes of the space portion S. For example, when the marks 141 are arranged in a manner where the sizes of the space portion S are increased according to the increasing numbers of the marks 141, the sizes of the space portion S can be minutely adjusted according to the adjustment of the marks 141 by the user, thereby providing the filling material having various densities to the user. Additionally, the size of the space portion S, that is, the density of the filling material 20 can be set adequate to the user, which will be set without any change when the filter case is exchanged with new one.

On the other hand, a ball member 170, which is made of a metal material like stainless steel, is disposed between the projection 113 of the fixing part 110 and the recess 121 of the rotating part 120, so as to prevent the filling material 20 from being excessively discharged through the discharge hole 123 when the shower 1 stops. At this time, the projection 113 takes an arch shape along the periphery of the ball member 170 on the top portion thereof, such that the ball member 170 is stably disposed between the projection 113 and the recess 121.

As shown in FIG. 7, the expanded body 10 is contracted and returned to its original state at the time of stopping the use of the shower 1, and at this time, a predetermined pressure is formed to push the ball member 170 toward the discharge hole 123, such that the discharge hole 123 becomes closed to prevent the filling material 20 from being excessively discharged, thereby avoiding the reduction of the use term of the filling material 20.

As described above, the filter case for the shower according to the present invention can adjust a quantity of outflow of a filling material arbitrarily by a user and further can be kept for a long period of time, which provides an economical advantage to the user.

The invention claimed is:

1. A filter case for a shower having a function of adjusting a quantity of outflow of a filling material, the filter case being embedded inside the shower in a state where a water-soluble filling material is filled therein, the filter case comprising:

a cylindrical body having a predetermined length and one open end portion, for containing the filling material therein; and an outflow quantity-adjusting means having a fixing part having one or more communicating holes adapted to communicate with an interior and an exterior of the body, the fixing part being fitted to the one open end portion of the body, and a rotating part having a discharge hole formed at an inside thereof passing through upper and lower surfaces thereof, the rotating part being screw-coupled to an inner periphery of the fixing part so as to block the one or more communicating holes of the fixing part, wherein as the rotating part is rotated around the fixing part, the one or more communicating holes of the fixing part are opened to form a space having a predetermined size between the one or more communicating holes of the fixing part and the discharge hole of the rotating part, thereby adjusting the quantity of outflow of the filling material, wherein the fixing part has a tapered projection formed at a center of a bottom portion thereof in such a manner as to be reduced in diameter toward an upper portion thereof, and the rotating part has a tapered recess adapted to insert the tapered projection of the fixing part thereinto in such a manner as to communicate with the discharge hole, such that, as the rotating part is rotated around the fixing part, a size of a space formed between the tapered projection and the tapered recess is adjusted to regulate the quantity of outflow of the filling material, and wherein the outflow quantity-adjusting means has a ball member disposed between the tapered projection and the tapered recess, the ball member being adapted to block the discharge hole using a pressure formed by the body when the shower stops, thereby preventing the filling material from being discharged.

2. The filter case for a shower according to claim 1, wherein the rotating part has a packing member mounted along an outer periphery thereof, the packing member being adapted to provide water tightness between the rotating part and the fixing part.

3. The filter case for a shower according to claim 1, wherein the rotating part has a longitudinal slot concavedly formed on a top surface thereof in such a manner as to insert a tool including a driver and a coin thereinto, thereby rotating the rotating part.

4. The filter case for a shower according to claim 1, wherein the rotating part has a plurality of marks formed along a top periphery thereof in such a manner as to be spaced apart from each other by a predetermined distance, the plurality of marks being in a form of a character or a number indicating the quantity of outflow of the filling material.

* * * * *